United States Patent [19]

Peterson et al.

[11] 4,251,343

[45] Feb. 17, 1981

[54] SACRIFICIAL ANODE APPARATUS

[75] Inventors: Marvin L. Peterson; Orwin G. Maxson, both of Ponca City, Okla.

[73] Assignee: Conoco, Inc., Ponca City, Okla.

[21] Appl. No.: 82,388

[22] Filed: Oct. 5, 1979

[51] Int. Cl.[3] ..... C23F 13/00

[52] U.S. Cl. ..... 204/197; 204/148

[58] Field of Search ..... 204/147, 148, 196, 197

[56] References Cited

U.S. PATENT DOCUMENTS

| | | | |
|---|---|---|---|
| 2,666,026 | 1/1954 | Gibbs | 204/197 |
| 2,916,429 | 12/1959 | Vossnack et al. | 204/197 |
| 3,010,891 | 11/1961 | Anderson | 204/196 |
| 3,108,940 | 10/1963 | Holdsworth | 204/196 |
| 3,616,421 | 10/1971 | Mackintosh | 204/197 |
| 4,056,446 | 11/1977 | Vennett | 204/197 |
| 4,089,767 | 5/1978 | Sabins | 204/197 |

*Primary Examiner*—T. Tung

*Attorney, Agent, or Firm*—Bayless E. Rutherford, Jr.

[57] ABSTRACT

A sacrificial anode apparatus for providing cathodic protection of metal structures, a portion of which is in water is disclosed. The anode apparatus comprises:

(a) a perforated subsurface container for anode material, (b) sacrificial anode material in continuous form extending through a conduit into the container from a source of supply located on the metal structure above water level, (c) a continuous source of supply for said anode material, (d) an electrical connection between the anode and the metal structure, and, (e) a device for feeding the anode material to the container in response to the electrochemical potential requirement of the structure being protected.

6 Claims, 7 Drawing Figures

SACRIFICIAL ANODE APPARATUS

BACKGROUND

1. Field of the Invention

The invention is in the field of providing cathodic protection of metal structures, especially steel offshore platforms, by the use of sacrificial anodes.

2. General Background

Sacrificial nodes and/or impressed current anodes are used on most offshore steel structures to prevent or reduce deterioration of the steel by an electrochemical process known as corrosion. Generally these anode systems must be installed during platform fabrication. Replacement while the structure is located in the sea is difficult and expensive because divers must be used and work in deep water must be limited because of the high cost and danger to the workmen. In an effort to provide adequate protection, many very large sacrificial anodes are required to protect a structure for a typical lifetime of 20 years. The additional weight and wave forces on the anodes can become quite significant.

Our invention represents an improvement over the prior art in that it is an apparatus wherein the sacrificial anode material can be replenished continuously by a simple process.

While offshore steel structures are a major use of the apparatus of our invention, the apparatus is suitable to provide corrosion protection on any metal structure a portion of which is in water (e.g. a ship, storage tank, etc.).

BRIEF SUMMARY OF THE INVENTION

Briefly stated, the present invention is directed to a sacrificial anode apparatus, for use on a metal structure, a portion of which is in water, said apparatus comprising:

(a) a perforated subsurface container for anode material, (b) sacrificial anode material in continuous form extending through a tube into the container from a source of supply located on the metal structure above water level, (c) a continuous source of supply for said anode material, (d) means for providing electrical connection between the anode and the metal structure, and, (e) means for feeding the anode material to the container in response to the electrochemical potential requirement of the structure being protected.

DESCRIPTION OF THE ILLUSTRATIVE EMBODIMENTS

Figure 1:
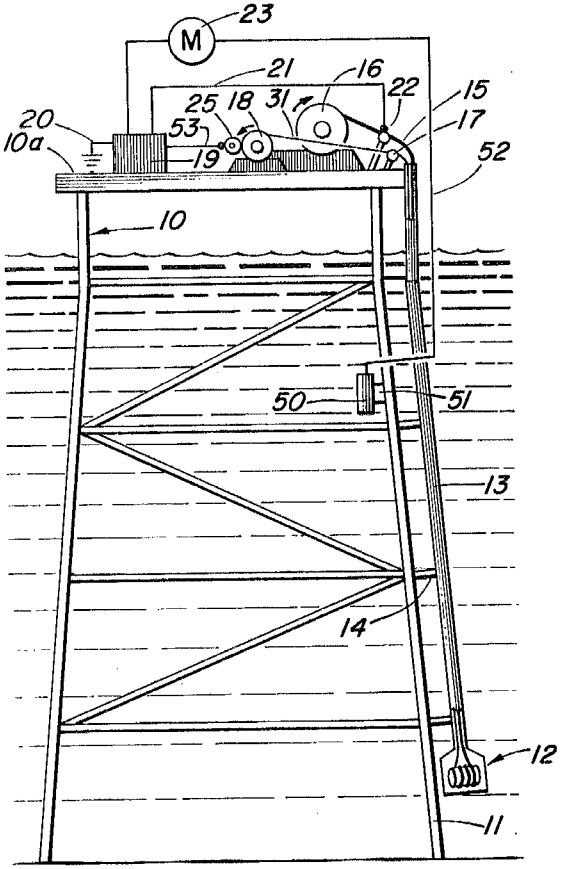
FIG. 1 is a view in side elevation of a typical installation incorporating one embodiment of the invention.

As shown in FIG. 1 an offshore platform 10 is supported by support members 11 which are partially immersed in sea water. A container 12 is located in the sea water, with a conduit (or tubing) 13 extending to the deck section 10*a*, located above water surface, of the platform 10. The tubing 13 and container 12 are attached to a support member 11 by means of clamps, rods, or welded brackets 14, and are electrically insulated from the platform. A reference electrode 50, located underneath the surface of the water, is attached to a platform support member 11 by means of an insulated clamp or rod 51. An insulated electrical conductor 52 goes from the reference electrode 50 to the control box 19 on the desk of the platform.

Figure 2:
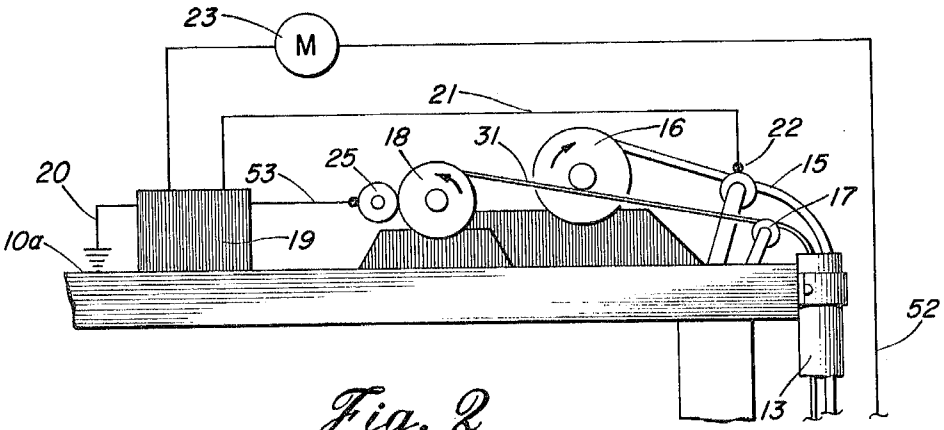
FIG. 2 is a view in side elevation of a portion of the apparatus of FIG. 1.

FIG. 2 shows that part of the apparatus located on the deck section 10*a* of the platform 10. The anode wire 15 is pulled from a feed reel 16 over a guide 17 to the tubing 13. It is pulled through the tubing 13 to a reel 41 as shown in FIG. 3.

Figure 3:
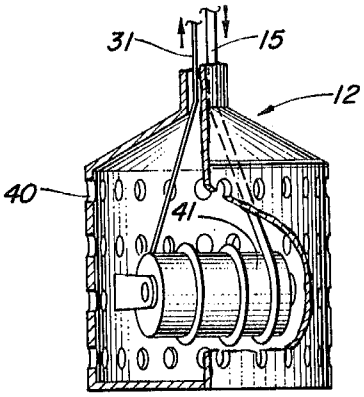
FIG. 3 is a cross-sectional view of a portion of the apparatus of FIG. 1.
Figure 4:
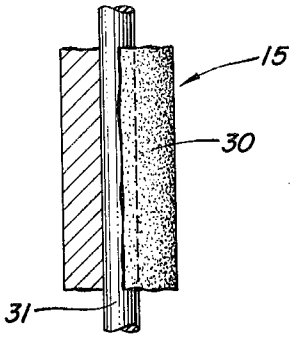
FIG. 4 is a cut-away view of the sacrificial anode wire of the apparatus of FIG. 1.

Reference is now made to FIGS. 3 and 4 before continuing the description of the apparatus in FIG. 2.

FIG. 4 is a cut-away view of the sacrificial anode wire 15. In the wire the outer layer 30 is made of a sacrificial anode material such as zinc or aluminum. This surrounds a corrosion resistant core 31 made of a material such as copper, or copper alloy.

FIG. 3 is a cross-sectional view of the container 12, which has perforations 40 to allow the sea water access to the interior of the container 12. The container 12 has a reel 41 around which several revolutions of the anode wire 15 pass. In the container the outer layer of sacrificial material 30 is consumed. The core wire 31 is pulled out of the container through the tubing 13 to the apparatus on the platform.

Referring again to FIG. 2 the core wire 31 emerges from the tubing 13 goes over a guide 17 to the drive reel 18. The movement of the wire is controlled by the control box 19, which is electrically attached to the platform at connection 20. This connection serves as a "ground", i.e. to complete the electrical circuit. An electrical conductor 21 from the control box is attached to the anode wire 15 by suitable means 22 such as a copper or flexible connection and goes to the control box.

An anode measuring device 23 is placed between the platform deck 10*a* and the reference electrode 50. The circuit is completed by the control box 19, ground connection 20 and electrical conductor 52. The anode measuring device measures the electrochemical requirement of the structure. The control box in response to this measurement through electrical conductor 53 actuates a suitable drive means 25 (motor, gears and/or pulleys) connected to the drive reel 18.

Figure 5:
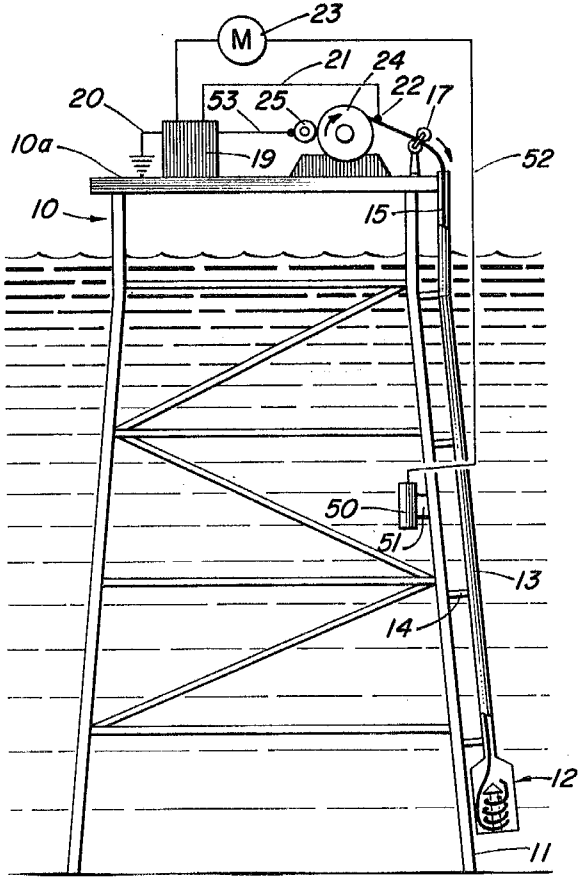
FIG. 5 is a view in side elevation of a typical installation incorporating a second embodiment of the invention.

As shown in FIG. 5, an offshore platform 10 is supported by support members 11 which are partially immersed in sea water. A container 12 is located in the sea water with a conduit (or tubing) 13 extending to the deck 10*a* of the platform 10. The tubing 13 and container 12 are attached to a support member 11 by means of clamps or rods 14, and are electrically insulated from the structure. A reference electrode 50, located underneath the surface of the water, is attached to a platform support member 11 by means of an insulated clamp or rod 51. An insulated electrical conductor 52 goes from the reference electrode 50 to the control box 19 on the desk of the platform.

Figure 6:
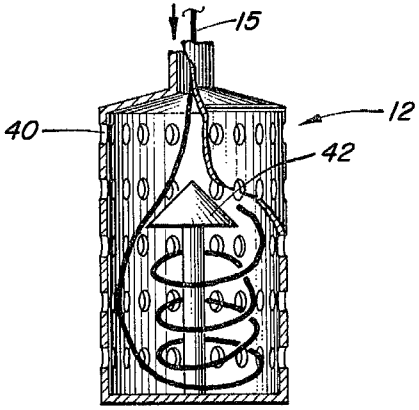
FIG. 6 is a view in side elevation of a portion of the apparatus of FIG. 5.

FIG. 6 is a cross-sectional view of the container 12 which has perforations 40 to allow the sea water access to the interior of the container 12. The container 12 has a deflector 42 in order to facilitate coiling of the anode wire 15. The anode wire 15 differs from that in the embodiment shown in FIGS. 1–4 in that it is made entirely of sacrificial anode material.

Figure 7:
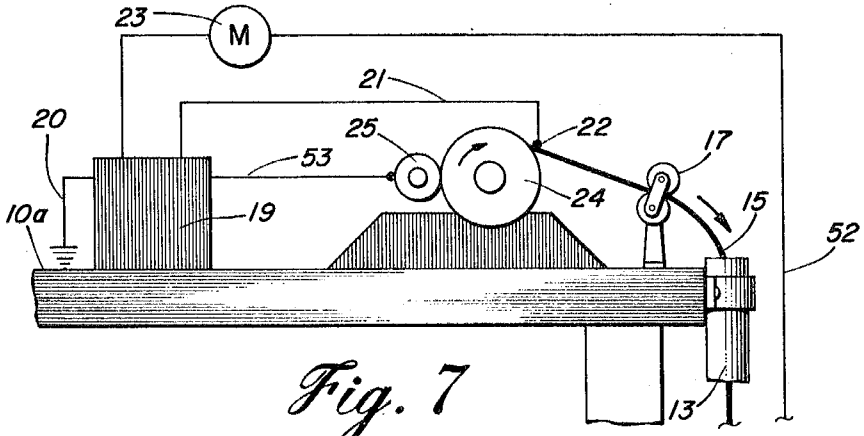
FIG. 7 is a cross-sectional view of a portion of the apparatus of FIG. 5.

FIG. 7 shows that part of the apparatus located on the deck 10*a* of platform 10. The anode wire 15 goes from the tubing 13 over a guide 17, which is non-conductive, to a combination drive-feed reel 24. The movement of the reel 24 is controlled by the control box 19, which is connected to the platform by a ground connection 20. An electrical conductor 21 from the control box is attached to the anode wire by suitable means 22 such as a wiper or flexible connection, and goes to the control box 19.

An anode measuring device 23 is placed between the platform deck 10*a* and the reference electrode 50. The circuit is completed by the control box 19, ground connection 20 and electrical conductor 52. The anode measuring device measures the electrochemical requirement of the structure. The control box in response to this measurement through electrical conductor 53 actuates a suitable drive means 25 (motor, gears) connected to the combination drivefeed reel 24.

DETAILED DESCRIPTION

While the following description may refer to the use of the apparatus of our invention on an offshore platform it is to be understood that the invention is not limited to this use.

The subsurface container for the sacrificial wire anode should contain perforations in order to allow the water access to the sacrificial anodes. The size of the subsurface container is not critical. It can be fabricated of steel, metal, suitable plastics or fiberglass. A preferred material for preparing the container is an epoxy-fiberglass composite molding.

The container can be supported by a number of suitable means with the only requirement be that the container (if conductive) is insulated from the platform or apparatus being protected. One means of supporting the container is by clamps or rods attached to the platform.

The anode is in the form of wires, cables, rods or bars. The primary requirements for the anode is that it be continuous (running from above the surface to the container) and that at least the outer surface be made of sacrificial anode material.

Sacrificial anodes are well-known in the art. Accordingly, the type of material used to prepare sacrificial anodes is well-known in the art. The material used for the anodes should have a higher anodic solution potential in the environment than does the metal of the structure being protected.

Since ordinarily offshore petroleum drilling and production platforms are constructed of structural steel the metal anode is made of materials such as zinc, aluminum, magnesium or alloys of these materials.

In going from the source of supply above the surface to the container the anode material (preferably wire anode) passes through a conduit or tube. The tube can be made of metal, preferably non-corrosive, or plastic. A plastic pipe of suitable diameter is an example of a preferred conduit.

The anode wire has a source of supply (e.g. wound on a reel) located above the surface of the water. The anode wire passes through the tube to the container. In one embodiment the wire is fed into the container where it forms a coil as shown in FIG. 6. In some instances in this embodiment it may be desirable to have a deflector located in the container in order to facilitate coiling. In this embodiment the anode wire is made entirely of sacrificial metal.

In another embodiment there is a reel in the container (as shown in FIG. 3). The wire used in this embodiment has a corrosion-resistant (e.g. copper) core and an outer layer of sacrificial metal. In this embodiment there is a drive means which pulls the wire. Preferably, the power means is located on the platform above surface. The anode wire is passed down through the conduit into the container and passes around the reel. While in the container the sacrificial metal is consumed. The non-corrosive core wire passes through the conduit to the drive means. In this embodiment the wire is pulled through the tube and container. The reel is designed to avoid wrapping one layer of anode wire over the other.

On the platform above the surface of the water there are located the source of anode wire supply, guide means for the anode wire and drive means for pushing or pulling the wire through the conduit and container.

A multiplicity of conduits and containers can be provided on the steel platform in order to protect the entire structure. The number of these can be readily determined by those skilled in the art. Also, the means of locating them on the platform can be readily determined.

As is implied throughout, our apparatus does not have an impressed current. The voltage and current are provided by the potential difference of the metal in the platform and the sacrificial anode metal.

An important feature of our apparatus is a control means, located above surface, for feeding the anode material to the container in response to the electrochemical demand of the anode. Optimally, the amount of material fed to the container is the same as the amount consumed. The control means is attached to the platform and is electrically connected to the anode wire by suitable means. This control means can work in several ways. Reference electrodes can be used. The voltage can be measured. These measurements can be used to automatically control the drive means which feeds the anode material to the container.

A typical control apparatus comprises the following. A voltmeter with a low limit switch which drives a solenoid switch. The solenoid switch controls an electric motor which drives the feed reel for the anode wire. The feed reel can either pull or push the anode wire through the conduit. The control apparatus has a timer cut-off switch in the circuit.

Our preferred apparatus comprises the following:

(a) perforated container made of epoxy-fiberglass composite molding, (b) tubing for feeding the anode material to the container, said tubing being made of plastic such as polyvinyl chloride, (c) an electrical conductor made of steel between the anode material and the metal structure being protected, (d) a control means for feeding the anode material to the container in response to the electrochemical demand, said control means comprising a voltmeter with a low limit switch driving a solenoid switch which drives an electric motor driving the feed reel with a timer cut-off switch for the system, (e)

(i) in one embodiment a reel is in the container. The anode wire has a copper center and is covered with aluminum as the sacrificial anode material. The anode wire is pulled through the apparatus.

(ii) in a second embodiment the container has a deflector. The anode wire is made entirely of the sacrificial anode material. The anode wire is pushed through the conduit and coiled around a deflector in the container.

The following example illustrates the invention using the preferred apparatus wherein the anode wire is made entirely of sacrificial anode material.

An offshore platform which is located in the Gulf of Mexico has a jacket weight of 3,200 tons. In order to protect the structure an average of 6 tons of anode material is required per year. This amounts to 1.35 pounds per hour. An apparatus is used which has 12 protective devices as described herein located about the structure. A No. 2 aluminum wire is used as the sacrificial anode. Using 220 inches per hour of the aluminum wire in each protective device provides corrosion protection for the platform.

Thus, having described the invention in detail, it will be understood by those skilled in the art that certain variations and modifications may be made without departing from the spirit and scope of the invention as defined herein and in the appended claims.

We claim:

1. A sacrificial anode apparatus for use on a metal structure a portion of which is in water, said apparatus comprising:

(a) a perforated subsurface container for anode material in continuous form, (b) sacrificial anode material in continuous form extending through a conduit into the container from a source of supply located on the metal structure above water level, (c) a continuous source of supply for said anode material, (d) means for providing electrical connection between the anode and the metal structure, and, (e) means for feeding the anode material to the container in response to the electrochemical potential requirement of the structure being protected.

2. A sacrificial anode apparatus for use on a metal structure a portion of which is in water, said apparatus comprising:

(a) a perforated subsurface container having therein a reel, (b) a sacrificial wire anode wound on said reel and being supplied to said reel through a tube from a source of supply located on the steel offshore platform above water level, said sacrificial wire anode comprising a core of non-corrosive material and an outer layer of sacrificial anode material, (c) a continuous source of supply for said anode material, (d) means for providing electrical connection between the anode and the platform, and (e) means for replenishing the wire anode in response to the electrochemical potential requirement of the structure being protected.

3. A sacrificial anode apparatus for use on a metal structure a portion of which is in water, said apparatus comprising:

(a) a perforated subsurface container for anode material in continuous form, (b) a sacrificial wire anode being fed into said subsurface container through a tube from a source of supply located on the steel offshore platform above water level, (c) a continuous source of supply for said sacrificial wire anode, (d) means for feeding the sacrificial anode material through the tube to the container, (e) means for providing electrical connection between the anode and the platform, and (f) means for replenishing sacrificial anode in said container in response to the electrochemical potential requirement of the structure being protected.

4. The apparatus of claims 1, 2 or 3 wherein the sacrificial anode is selected from the group consisting of zinc, aluminum, magnesium and alloys thereof.

5. The apparatus of claim 4 wherein the sacrificial anode is aluminum.

6. The apparatus of claim 5 wherein the electrochemical potential requirement is obtained by a reference electrode.

* * * * *